US010332459B2

(12) United States Patent
Wang et al.

(10) Patent No.: US 10,332,459 B2
(45) Date of Patent: Jun. 25, 2019

(54) DISPLAY DEVICE AND A DRIVING METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Xiurong Wang, Beijing (CN); Bo Gao, Beijing (CN); Lingyun Shi, Beijing (CN); Hao Zhang, Beijing (CN); Yafei Li, Beijing (CN); Peng Han, Beijing (CN); Chen Meng, Beijing (CN); Zijiao Xue, Beijing (CN); Tiankuo Shi, Beijing (CN); Quanhua He, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 172 days.

(21) Appl. No.: 15/325,052

(22) PCT Filed: Feb. 18, 2016

(86) PCT No.: PCT/CN2016/073995
§ 371 (c)(1),
(2) Date: Jan. 9, 2017

(87) PCT Pub. No.: WO2017/036098
PCT Pub. Date: Mar. 9, 2017

(65) Prior Publication Data

US 2017/0221428 A1 Aug. 3, 2017

(30) Foreign Application Priority Data

Sep. 2, 2015 (CN) ..... 2015 1 0558110

(51) Int. Cl.
*G09G 3/36* (2006.01)

(52) U.S. Cl.
CPC ..... *G09G 3/36* (2013.01); *G09G 2310/061* (2013.01); *G09G 2310/08* (2013.01);
(Continued)

(58) Field of Classification Search
None
See application file for complete search history.

(56) References Cited

U.S. PATENT DOCUMENTS

2008/0122824 A1* 5/2008 Lee ..... G09G 3/3696 345/211
2009/0083556 A1* 3/2009 Zimek ..... H02M 1/10 713/310

(Continued)

FOREIGN PATENT DOCUMENTS

CN 1542527 A 11/2004
CN 101191927 A 6/2008

(Continued)

OTHER PUBLICATIONS

Office Action in Chinese Application No. 201510558110.4 dated Oct. 10, 2017, with English translation.

(Continued)

*Primary Examiner* — Ifedayo B Iluyomade
(74) *Attorney, Agent, or Firm* — Womble Bond Dickinson (US) LLP

(57) ABSTRACT

The present application discloses a display device and a driving method. The display device comprises: a power reset circuit and a source drive chip for driving a display panel to display. An input terminal of the power reset circuit is connected with a power signal output terminal, a control terminal of the power reset circuit is connected with a reset signal terminal, an output terminal of the power reset circuit (Continued)

is connected with a power signal input terminal of the source drive chip. The power reset circuit is used for resetting a power signal synchronously when receiving a reset signal, and inputting the reset power signal into the power signal input terminal of the source drive chip.

15 Claims, 3 Drawing Sheets

(52) U.S. Cl.
CPC ..... *G09G 2330/04* (2013.01); *G09G 2330/06* (2013.01); *G09G 2330/08* (2013.01); *G09G 2330/12* (2013.01)

(56) References Cited

U.S. PATENT DOCUMENTS

| | | | |
|---|---|---|---|
| 2013/0180967 | A1 | 7/2013 | Teng et al. |
| 2014/0118330 | A1 | 5/2014 | Lee et al. |

FOREIGN PATENT DOCUMENTS

| | | | |
|---|---|---|---|
| CN | 102377445 | A | 3/2012 |
| CN | 102693704 | A | 9/2012 |
| CN | 102811040 | A | 12/2012 |
| CN | 203225069 | U | 10/2013 |
| CN | 103745705 | A | 4/2014 |
| CN | 103794171 | A | 5/2014 |
| CN | 103929161 | A | 7/2014 |
| CN | 105185330 | A | 12/2015 |
| JP | 2003107507 | A | 4/2003 |
| TW | I 482361 | B | 4/2015 |

OTHER PUBLICATIONS

International Search Report and Written Opinion in PCT/CN2016/073995 dated Jun. 7, 2016, with English translation. 16 pages.
Office Action in Chinese Application No. 201510558110.4 dated May 2, 2017, with English translation.

* cited by examiner

DISPLAY DEVICE AND A DRIVING METHOD

The present application is the U.S. national phase entry of PCT/CN2016/073995, with an international filing date of Feb. 18, 2016, which claims the benefit of Chinese Patent Application No. 20151058110.4, filed on Sep. 2, 2015, the entire disclosure of which is incorporated herein by reference.

TECHNICAL FIELD

The present application relates to the field of display technology, particularly to a display device and a driving method.

BACKGROUND

At present, in liquid crystal display products, the main board control terminal is provided with a general antistatic mechanism. Generally, the main board control unit will send a read command to the source drive chip of the liquid crystal display module at intervals, so as to read the characterization value of the electrostatic status register of the source drive chip, i.e., the state value of the 0A register, thereby determining whether a reset signal will be sent to reset the source drive chip.

Generally, when the source drive chip has electrostatic abnormity, it has to be reset; the reset process thereof is as shown in FIG. 1. Take the 0A register as an example, the process specifically includes: S10, reading the state value of the 0A register of the source drive chip by the control unit at every fixed time interval; S11, not inputting a reset signal to the source drive chip, and not resetting the source drive chip when the value of 09 characterizing normal operation of the source drive chip is read; S12, inputting a reset signal to the source drive chip, and controlling the source drive chip to be reset when the value characterizing abnormal operation of the source drive chip, i.e., the value of not 09 characterizing electrostatic abnormity of the source drive chip, is read. However, sometimes the source drive chip with electrostatic abnormity cannot be reset under the control of the reset signal; thus, the electrostatic detection mechanism will fail, thereby influencing normal operation of the liquid crystal display module.

Therefore, a problem to be solved by the skilled person in the art urgently is that, how to ensure reset of the source drive chip under the control of the reset signal and improve the situation of failure of reset of the source drive chip in case of electrostatic abnormity, thereby enhancing antistatic ability of the liquid crystal display module.

SUMMARY

Embodiments of the present application provide a display device and a driving method, for ensuring reset of the source drive chip under the control of the reset signal and improving the situation of failure of reset of the source drive chip in case of electrostatic abnormity, thereby enhancing antistatic ability of the liquid crystal display module.

One aspect of the present application provides a display device, comprising: a power reset circuit and a source drive chip for driving a display panel to display.

An input terminal of the power reset circuit is connected with a power signal output terminal, a control terminal of the power reset circuit is connected with a reset signal terminal, and an output terminal of the power reset circuit is connected with a power signal input terminal of the source drive chip.

The power reset circuit is used for resetting a power signal synchronously when receiving a reset signal, and inputting the reset power signal into the power signal input terminal of the source drive chip.

In one embodiment, the power reset circuit comprises: a first switch transistor, a second switch transistor, a first resistor and a second resistor.

A gate of the first switch transistor is connected with the reset signal output terminal, a source of the first switch transistor is connected with one terminal of the first resistor and a gate of the second switch transistor respectively, and a drain of the first switch transistor is connected with a ground level signal terminal.

The other terminal of the first resistor is connected with the power signal output terminal and a source of the second switch transistor respectively.

A drain of the second switch transistor is connected with one terminal of the second resistor and the power signal input terminal of the power driver chip respectively.

The other terminal of the second resistor is connected with the ground level signal terminal.

In one embodiment, the source drive chip comprises a status register.

The status register is used for outputting a first characterization value characterizing that the source drive chip is in an abnormal operating state when the source drive chip has electrostatic abnormity, and outputting a second characterization value characterizing that the source drive chip is in a normal operating state when the source drive chip operates normally.

In one embodiment, the display device further comprises a control unit.

The control unit is used for reading characterization values of the status register at every preset time interval;

inputting a reset signal to the control terminal of the power reset circuit when reading the first characterization value, and not inputting the reset signal to the control terminal of the power reset circuit when reading the second characterization value.

In one embodiment, the control unit is further used for inputting the reset signal to the reset terminal of the source drive chip when reading the first characterization value.

In one embodiment, the power reset circuit and the control unit are arranged on a flexible circuit board.

The other aspect of the present application provides a power signal reset driving method for use in a display device provided by embodiments of the present application, comprising:

when receiving a reset signal, the power reset circuit resetting a power signal synchronously, and inputting the reset power signal into the power signal input terminal of the source drive chip.

In one embodiment, the power signal reset driving method further comprises:

reading characterization values characterizing the operating states of the source drive chip at every preset time interval;

inputting the reset signal to the control terminal of the power reset circuit after it is determined that the source drive chip has electrostatic abnormity.

In one embodiment, in the power signal reset driving method, reading characterization values characterizing the operating states of the source drive chip comprises:

reading a first characterization value characterizing that the source drive chip is in an abnormal operating state when the source drive chip has electrostatic abnormity, and reading a second characterization value characterizing that the source drive chip is in a normal operating state when the source drive chip operates normally.

In one embodiment, in the power signal reset driving method, inputting the reset signal to the control terminal of the power reset circuit after it is determined that the source drive chip has electrostatic abnormity comprises:

inputting the reset signal to the control terminal of the power reset circuit when reading the first characterization value, and not inputting the reset signal to the control terminal of the power reset circuit when reading the second characterization value.

In one embodiment, the power signal reset driving method further comprises: inputting the reset signal to the reset terminal of the source drive chip when reading the first characterization value.

Embodiments of the present application provide a display device and a driving method. The display device comprises: a power reset circuit and a source drive chip for driving a display panel to display. An input terminal of the power reset circuit is connected with a power signal output terminal, a control terminal of the power reset circuit is connected with a reset signal terminal, an output terminal of the power reset circuit is connected with a power signal input terminal of the source drive chip. The power reset circuit is used for resetting a power signal synchronously when receiving a reset signal, and inputting the reset power signal into the power signal input terminal of the source drive chip. By adding a power reset circuit in the display device, when the source drive chip has electrostatic abnormity, the power signal can be reset synchronously and the reset power signal can be inputted to the power signal input terminal of the source drive chip, so as to initialize the source drive chip, drive the source drive chip again, ensure that the source drive chip can be reset in case of electrostatic abnormity, and improve the situation of failure of reset of the source drive chip in case of electrostatic abnormity, thereby enhancing antistatic ability of the liquid crystal display module.

DETAILED DESCRIPTION

Next, the specific implementation of the display device and the driving method provided by embodiments of the present application will be explained in detail with reference to the drawings.

Figure 1:
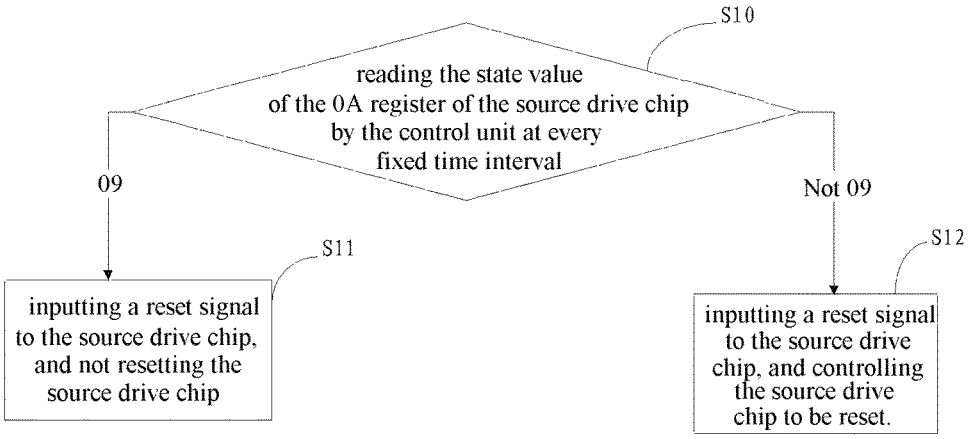
FIG. 1 is a flow chart of a reset driving method when the source drive chip has electrostatic abnormity in the prior art.
Figure 2:
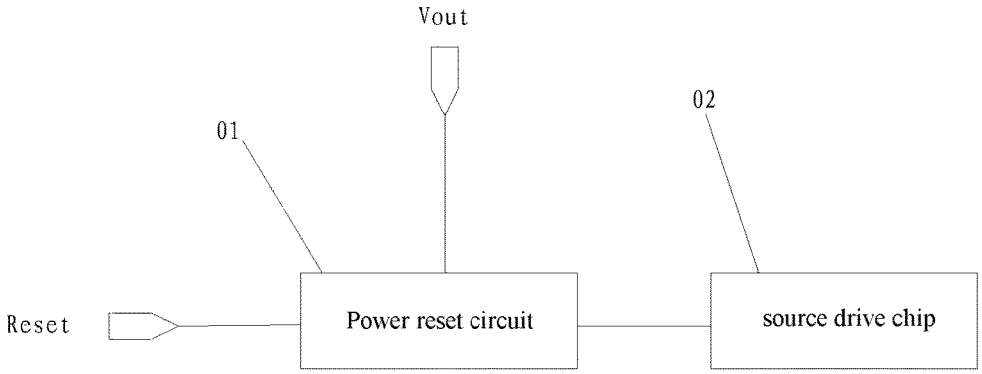
FIG. 2 is a structural schematic view of a display device provided by embodiments of the present application.

Embodiments of the present invention provides a display device, as shown in FIG. 2. The display device can comprise: a power reset circuit 01 and a source drive chip 02 for driving a display panel to display.

An input terminal of the power reset circuit 01 is connected with a power signal output terminal Vout, a control terminal of the power reset circuit 01 is connected with a reset signal terminal Reset, and an output terminal of the power reset circuit 01 is connected with a power signal input terminal of the source drive chip.

The power reset circuit 01 is used for resetting a power signal synchronously when receiving a reset signal, and inputting the reset power signal into the power signal input terminal of the source drive chip 02.

The above display device provided by embodiments of the present application comprises: a power reset circuit 01 and a source drive chip 02 for driving a display panel to display. An input terminal of the power reset circuit 01 is connected with a power signal output terminal Vout, a control terminal of the power reset circuit 01 is connected with a reset signal terminal Reset, and an output terminal of the power reset circuit 01 is connected with a power signal input terminal of the source drive chip 02. The power reset circuit 01 is used for resetting a power signal synchronously when receiving a reset signal, and inputting the reset power signal into the power signal input terminal of the source drive chip 02. By adding a power reset circuit in the display device, when the source drive chip has electrostatic abnormity, the power signal can be reset synchronously and the reset power signal can be inputted to the power signal input terminal of the source drive chip, so as to initialize the source drive chip, drive the source drive chip again, ensure that the source drive chip can be reset in case of electrostatic abnormity, and improve the situation of failure of reset of the source drive chip in case of electrostatic abnormity, thereby enhancing antistatic ability of the liquid crystal display module.

Figure 3:
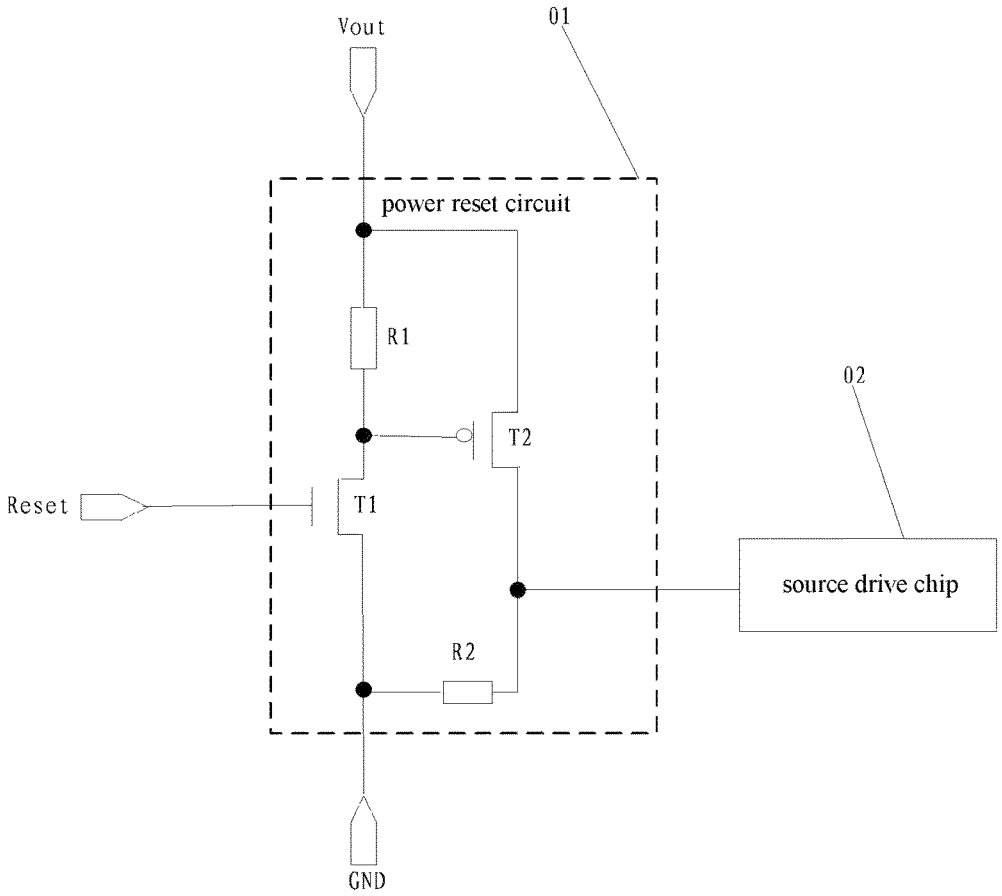
FIG. 3 is a specific structural schematic view of a display device provided by embodiments of the present application.

As shown in FIG. 3, the power reset circuit 01 can comprise: a first switch transistor T1, a second switch transistor T2, a first resistor R1 and a second resistor R2. A gate of the first switch transistor T1 is connected with the reset signal output terminal Reset, a source of the first switch transistor T1 is connected with one terminal of the first resistor R1 and a gate of the second switch transistor T2 respectively, and a drain of the first switch transistor T1 is connected with a ground level signal terminal GND. The other terminal of the first resistor R1 is connected with the power signal output terminal Vout and a source of the second switch transistor T2 respectively. A drain of the second switch transistor T2 is connected with one terminal of the second resistor R2 and the power signal input terminal of the power driver chip 02 respectively. The other terminal of the second resistor R2 is connected with the ground level signal terminal GND.

When the display device operates normally, the reset signal terminal Reset outputs a high level, and the power signal output terminal Vout outputs a high level signal, here the first switch transistor T1 is turned on. The first switch transistor T1 that has been turned on conducts the gate of the second switch transistor T2 with the ground level signal terminal GND; hence, the gate of the second switch transistor T2 is a low level signal. The second switch transistor T2 is a P-type transistor; hence, the second switch transistor T2 is turned on. The second switch transistor T2 that has been turned on transmits the high level signal outputted by the power signal output terminal Vout to the power signal input terminal of the source drive chip 02, such that the source drive chip can operate normally. When the reset signal terminal Reset outputs a low level signal, the first switch transistor T1 is cut off. The gate of the second switch transistor T2 is a high level signal; hence, the second switch transistor T2 is also cut off. Here, the signal inputted to the power signal input terminal of the source drive chip is a low level signal; hence, the source drive chip is reset. After the source drive chip is reset, the reset signal terminal Reset outputs the high level signal again, and the signal inputted to the power signal input terminal of the source drive chip is recovered as a high level signal; thus the act of reseting the power signal through the signal of the reset signal terminal Reset is accomplished, such that when the source drive chip has electrostatic abnormity, the power signal can be reset synchronously, so as to ensure that the source drive chip can be reset when having electrostatic abnormity.

It should be noted that the switch transistors mentioned in the above embodiments of the present application can be thin film transistors (TFT), and can also be metal oxide semiconductor (MOS) transistors, which will not be defined here. In specific implementation, the sources and the drains of these transistors can be interchanged, which will not be differentiated specifically. When specific embodiments are described, for example, the transistors are thin film transistors.

The source drive chip can comprise a status register. The status register is used for outputting a first characterization value characterizing that the source drive chip is in an abnormal operating state when the source drive chip has electrostatic abnormity, and outputting a second characterization value characterizing that the source drive chip is in a normal operating state when the source drive chip operates normally. Specifically, the operating state of the source drive chip can be characterized by the status register. Take the 0A register as an example, when the source drive chip has electrostatic abnormity, the 0A register can output a characterization value 09 characterizing that the source drive chip has electrostatic abnormity, thereby facilitating the control unit of the display device to read the operating state of the source drive chip. When the source drive chip has electrostatic abnormity, a reset signal is outputted to control the source drive chip to be reset. Meanwhile, the power reset circuit resets the power signal synchronously under the control of the reset signal, so as to ensure that the source drive chip can be reset when having electrostatic abnormity, and improve the situation of failure of reset of the source drive chip when having electrostatic abnormity. In addition, the electrostatic abnormity status register comprised by the source drive chip can be a 0A register and can also be registers of other types, which will not be defined here.

The display device can further comprise a control unit. The control unit is used for reading characterization values of the status register at every preset time interval. A reset signal is inputted to the control terminal of the power reset circuit when reading the first characterization value, and the reset signal is not inputted to the control terminal of the power reset circuit when reading the second characterization value. Specifically, the control unit reads characterization values of the status register at every preset time interval, and inputs a reset signal to the power reset circuit when it is determined that the source drive chip has electrostatic abnormity, so as to reset the power signal synchronously and ensure that the source drive chip can be reset when having electrostatic abnormity.

The control unit is further used for inputting the reset signal to the reset terminal of the source drive chip when reading the first characterization value. Specifically, the control unit outputs a reset signal synchronously to the source drive chip and the power reset circuit when the source drive chip has electrostatic abnormity, so as to control the source drive chip to be reset. Meanwhile, in order to improve the situation of failure of reset of the source drive chip when having electrostatic abnormity, the power signal is reset synchronously through the power reset circuit under the control of the reset signal, so as to ensure that the source drive chip can be reset when having electrostatic abnormity, thereby enhancing antistatic ability of the display device.

The power reset circuit and the control unit can be arranged on a flexible circuit board. Specifically, the power reset circuit and the control unit are arranged on a flexible circuit board, so as to be bond with the display panel synchronously. When the source drive chip has electrostatic abnormity, a reset signal controls the source drive chip and the power reset circuit to realize synchronous reset of the source drive chip and the power signal, so as to ensure that the source drive chip can be reset when having electrostatic abnormity, and improve the situation of failure of reset of the source drive chip when having electrostatic abnormity, thereby enhancing the antistatic ability of the display device.

Based on the same inventive concept, embodiments of the present application provide a power signal reset driving method for use in a display device as stated above, which can comprise: when receiving a reset signal, the power reset circuit resetting a power signal synchronously, and inputting the reset power signal into the power signal input terminal of the source drive chip. Specifically, when the source drive chip has electrostatic abnormity, the power reset circuit is controlled through a control signal, so as to realize synchronous reset of the power signal, and input the reset power signal to the power signal input terminal of the source drive chip. In this way, when the source drive chip is reset, the power signal can be reset synchronously, so as to initialize the source drive chip, reset the source drive chip, ensure that the source drive chip can be reset in case of electrostatic abnormity, and improve the situation of failure of reset of the source drive chip in case of electrostatic abnormity, thereby enhancing antistatic ability of the liquid crystal display module.

The power signal reset driving method can further comprise: reading characterization values characterizing the operating states of the source drive chip at every preset time interval; inputting the reset signal to the control terminal of the power reset circuit after it is determined that the source drive chip has electrostatic abnormity. Specifically, in the power signal reset driving method, the characterization values characterizing the operating states of the source drive chip are read at every preset time interval, so as to input a reset signal to the control terminal of the power reset circuit when the source drive chip has electrostatic abnormity, realize synchronous reset of the power signal, and ensure that the source drive chip can be reset when having electrostatic abnormity.

In specific implementation, in the power signal reset driving method, reading characterization values characterizing the operating states of the source drive chip can comprise: reading a first characterization value characterizing that the source drive chip is in an abnormal operating state when the source drive chip has electrostatic abnormity, and reading a second characterization value characterizing that the source drive chip is in a normal operating state when the source drive chip operates normally. Specifically, the operating state of the source drive chip can be characterized by the status register, and the control unit reads characterization values characterizing the operating states of the source drive chip at every preset time interval. When the first characterization value characterizing that the source drive chip is in an abnormal operating state is read, it is determined that the source drive chip has electrostatic abnormity, thereby outputting a reset signal to the control terminal of the power reset circuit. The power reset circuit resets the power signal under the control of the reset signal, and inputs the reset power signal to the power signal input terminal of the source drive chip, so as to control the source drive chip to be reset. In this way, when the source drive chip has electrostatic abnormity, it ensures that the source drive chip can be reset, improves the situation of failure of reset of the source drive chip when having electrostatic abnormity, thereby enhancing the antistatic ability of the liquid crystal display module.

In specific implementation, in the power signal reset driving method, inputting the reset signal to the control terminal of the power reset circuit after it is determined that the source drive chip has electrostatic abnormity can comprise: inputting the reset signal to the control terminal of the power reset circuit when reading the first characterization value, and not inputting the reset signal to the control terminal of the power reset circuit when reading the second characterization value. Specifically, the control unit reads characterization values outputted by the status register at every preset time interval, and outputs a reset signal to the power reset circuit when the source drive chip has electrostatic abnormity, i.e., when reading the first characterization value, so as to control the power reset circuit to reset the power signal synchronously and ensure reset of the source drive chip.

In specific implementation, the power signal reset driving method can further comprise: inputting the reset signal to the reset terminal of the source drive chip when reading the first characterization value. Specifically, the control unit outputs a reset signal to the source drive chip and the power reset circuit synchronously when the source drive chip has electrostatic abnormity, so as to control reset of the source drive chip. Meanwhile, in order to improve the situation of failure of reset of the source drive chip when having electrostatic abnormity, the power signal is reset synchronously through the power reset circuit under the control of the reset signal, so as to ensure that the source drive chip can be reset when having electrostatic abnormity, thereby enhancing antistatic ability of the display device.

Figure 4:
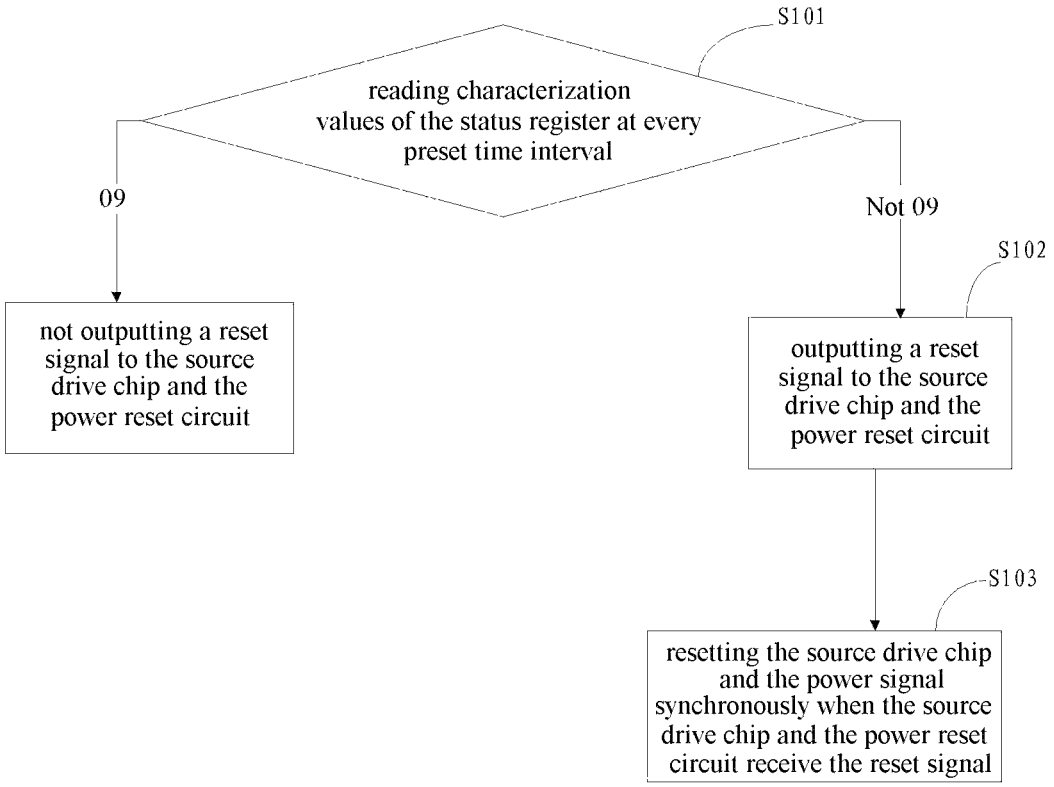
FIG. 4 is a flow chart of a driving method of performing synchronous reset of the source drive chip and the power signal by a display device provided by embodiments of the present application.

Next, the specific process of performing synchronous reset of the source drive chip and the power signal by the display device provided by embodiments of the present invention will be explained in detail with a specific embodiment, the specific process is as shown in FIG. 4:

S101, reading characterization values of the status register at every preset time interval, take the 0A register as an example, if the characterization value is 09, it indicates that the source drive chip is in a normal operating state; if the characterization value is not 09, it indicates that the source drive chip is in an abnormal operating state, i.e., the source drive chip has electrostatic abnormity.

S102, outputting a reset signal to the source drive chip and the power reset circuit if the characterization value of the status register is not 09; not outputting a reset signal to the source drive chip and the power reset circuit if the characterization value of the status register is 09.

S103, resetting the source drive chip and the power signal synchronously when the source drive chip and the power reset circuit receive the reset signal.

Embodiments of the present application provide a display device and a driving method. The display device comprises: a power reset circuit and a source drive chip for driving a display panel to display. An input terminal of the power reset circuit is connected with a power signal output terminal, a control terminal of the power reset circuit is connected with a reset signal terminal, an output terminal of the power reset circuit is connected with a power signal input terminal of the source drive chip. The power reset circuit is used for resetting a power signal synchronously when receiving a reset signal, and inputting the reset power signal into the power signal input terminal of the source drive chip. By adding a power reset circuit in the display device, when the source drive chip has electrostatic abnormity, the power signal is reset synchronously and the reset power signal is inputted to the power signal input terminal of the source drive chip, so as to initialize the source drive chip, drive the source drive chip again, ensure that the source drive chip can be reset in case of electrostatic abnormity, and improve the situation of failure of reset of the source drive chip in case of electrostatic abnormity, thereby enhancing antistatic ability of the liquid crystal display module.

Apparently, the skilled person in the art can make various amendments and modifications to the present application without departing from the spirit and the scope of the present application. In this way, provided that these amendments and modifications of the present invention belong to the scopes of the claims of the present application and the equivalent technologies thereof, the present application also intends to encompass these amendments and modifications.

The invention claimed is:

1. A display device, comprising: a power reset circuit and a source drive chip for driving a display panel to display; wherein, an input terminal of the power reset circuit is connected with a power signal output terminal, a control terminal of the power reset circuit is connected with a reset signal terminal, an output terminal of the power reset circuit is connected with a power signal input terminal of the source drive chip, the power reset circuit is used for resetting a power signal synchronously when receiving a reset signal, and inputting the reset power signal into the power signal input terminal of the source drive chip, wherein the power reset circuit comprises: a first switch transistor, a second switch transistor, a first resistor and a second resistor, wherein, a gate of the first switch transistor is connected with the reset signal output terminal, a source of the first switch transistor is connected with one terminal of the first resistor and a gate of the second switch transistor respectively, a drain of the first switch transistor is connected with a ground level signal terminal, the other terminal of the first resistor is connected with the power signal output terminal and a source of the second switch transistor respectively, a drain of the second switch transistor is connected with one terminal of the second resistor and the power signal input terminal of the power driver chip respectively, the other terminal of the second resistor is connected with the ground level signal terminal.

2. The display device as claimed in claim 1, wherein the source drive chip comprises: a status register—wherein, the status register is used for outputting a first characterization value characterizing that the source drive chip is in an abnormal operating state when the source drive chip has electrostatic abnormity, and outputting a second characterization value characterizing that the source drive chip is in a normal operating state when the source drive chip operates normally.

3. The display device as claimed in claim 2, further comprising: a control unit, wherein, the control unit is used for reading characterization values of the status register at every preset time interval, inputting a reset signal to the control terminal of the power reset circuit when reading the first characterization value, and not inputting the reset signal to the control terminal of the power reset circuit when reading the second characterization value.

4. The display device as claimed in claim 3, wherein the control unit is further used for inputting the reset signal to the reset terminal of the source drive chip when reading the first characterization value.

5. The display device as claimed in claim 4, wherein the power reset circuit and the control unit are arranged on a flexible circuit board.

6. A power signal reset driving method for use in a display device as claimed in claim 1, comprising:

when receiving a reset signal, the power reset circuit resetting a power signal synchronously, and inputting the reset power signal into the power signal input terminal of the source drive chip.

7. The method as claimed in claim 6, further comprising:

reading characterization values characterizing the operating states of the source drive chip at every preset time interval, inputting the reset signal to the control terminal of the power reset circuit after it is determined that the source drive chip has electrostatic abnormity.

8. The method as claimed in claim 7, wherein reading characterization values characterizing the operating states of the source drive chip comprises:

reading a first characterization value characterizing that the source drive chip is in an abnormal operating state when the source drive chip has electrostatic abnormity, and reading a second characterization value characterizing that the source drive chip is in a normal operating state when the source drive chip operates normally.

9. The method as claimed in claim 8, wherein inputting the reset signal to the control terminal of the power reset circuit after it is determined that the source drive chip has electrostatic abnormity comprises:

inputting the reset signal to the control terminal of the power reset circuit when reading the first characterization value, and not inputting the reset signal to the control terminal of the power reset circuit when reading the second characterization value.

10. The method as claimed in claim 9, further comprising: inputting the reset signal to the reset terminal of the source drive chip when reading the first characterization value.

11. The method as claimed in claim 6, wherein the power reset circuit comprises: a first switch transistor, a second switch transistor, a first resistor and a second resistor, wherein, a gate of the first switch transistor is connected with the reset signal output terminal, a source of the first switch transistor is connected with one terminal of the first resistor and a gate of the second switch transistor respectively, a drain of the first switch transistor is connected with a ground level signal terminal, the other terminal of the first resistor is connected with the power signal output terminal and a source of the second switch transistor respectively, a drain of the second switch transistor is connected with one terminal of the second resistor and the power signal input terminal of the power driver chip respectively, the other terminal of the second resistor is connected with the ground level signal terminal.

12. The method as claimed in claim 11, wherein the source drive chip comprises: a status register, wherein, the status register is used for outputting a first characterization value characterizing that the source drive chip is in an abnormal operating state when the source drive chip has electrostatic abnormity, and outputting a second characterization value characterizing that the source drive chip is in a normal operating state when the source drive chip operates normally.

13. The method as claimed in claim 12, further comprising: a control unit, wherein, the control unit is used for reading characterization values of the status register at every preset time interval, inputting a reset signal to the control terminal of the power reset circuit when reading the first characterization value, and not inputting the reset signal to the control terminal of the power reset circuit when reading the second characterization value.

14. The method as claimed in claim 13, wherein the control unit is further used for inputting the reset signal to the reset terminal of the source drive chip when reading the first characterization value.

15. The method as claimed in claim 14, wherein the power reset circuit and the control unit are arranged on a flexible circuit board.

* * * * *